US005990771A

United States Patent [19]

Quentric

[11] Patent Number: 5,990,771

[45] Date of Patent: Nov. 23, 1999

[54] CONTACTOR FOR A MOTOR VEHICLE STARTER, HAVING IMPROVED PROTECTION FOR AN ELECTRONIC CIRCUIT OF THE CONTACTOR

[75] Inventor: Jean-François Quentric, Saint Bonnet de Mure, France

[73] Assignee: Valeo Equipements Electriques Moteur, Creteil, France

[21] Appl. No.: 09/022,787

[22] Filed: Feb. 12, 1998

[30] Foreign Application Priority Data

Feb. 14, 1997 [FR] France ..... 97.01855

[51] Int. Cl.[6] ..... H01H 67/02

[52] U.S. Cl. ..... 335/126; 335/131

[58] Field of Search ..... 335/126, 131–2, 335/229

[56] References Cited

U.S. PATENT DOCUMENTS

| | | | |
|---|---|---|---|
| 4,644,179 | 2/1987 | Pointout et al. | 361/192 |
| 5,703,551 | 12/1997 | Lefebvre et al. | 335/126 |
| 5,770,901 | 6/1998 | Niimi et al. | 310/52 |

FOREIGN PATENT DOCUMENTS

| | | |
|---|---|---|
| 0 390 553 | 10/1990 | European Pat. Off. . |
| 0 751 545 | 1/1997 | European Pat. Off. . |
| 2 586 855 | 3/1987 | France . |
| 42 18 543 | 12/1993 | Germany . |
| 2 193 845 | 2/1988 | United Kingdom . |

OTHER PUBLICATIONS

French Search Report dated Nov. 14, 1997.

*Primary Examiner*—Lincoln Donovan
*Attorney, Agent, or Firm*—Morgan & Finnegan, L.L.P.

[57] ABSTRACT

In a motor vehicle starter contactor, a control plunger controls the axial displacements of a contact plate which is arranged in a front cover of the contactor. A fixed transverse core is arranged axially in front of the contactor winding, and an electronic circuit is fitted inside the cover, between the fixed core and a partition which divides the interior of the cover into two compartments. The partition, in the form of a separating plate, has a transverse wall portion and an axial bush in which the plunger slides. The bush has a central bore which is open at the front forwardly of the transverse wall portion, and open at the rear behind the fixed core.

10 Claims, 2 Drawing Sheets

CONTACTOR FOR A MOTOR VEHICLE STARTER, HAVING IMPROVED PROTECTION FOR AN ELECTRONIC CIRCUIT OF THE CONTACTOR

FIELD OF THE INVENTION

This invention relates to contactors for motor vehicle starters, of the kind including an electronic circuit. More particularly, the invention relates to an electrical contactor of the type comprising a movable magnetic core which is displaceable coaxially, in the axial direction, in a winding, and which acts on a plunger that controls displacements of a contact plate for electrically connecting together two terminals of the contactor, the contactor further being of the type in which the control plunger extends axially forward through a hole formed in a fixed transverse core of the contactor, the fixed core being disposed axially in front of the winding, the contact plate being received within a hollow cover arranged in front of the winding, the contactor being also of the type in which an electronic circuit is disposed within the cover, between the fixed magnetic core and a separating plate through which the control plunger passes.

BACKGROUND OF THE INVENTION

It is known to make use of electronic control circuits for controlling the power supply for energising the winding of the contactor. Such electronic circuits give substantially perfect control of the displacement of the movable core of the contactor, this displacement being that which, firstly, puts the starter pinion into mesh with the toothed starter crown of the internal combustion engine of a motor vehicle, and secondly completes the power circuit so as to start the electric starter motor which initially drives the vehicle engine in rotation.

It was originally proposed to arrange the electronic circuit on the outside of the contactor, but it rapidly became clear that it was preferable to incorporate it with the front cover of the contactor, so as to reduce the total bulk of the latter. However, electronic circuits are very sensitive to dust, humidity and the presence of metallic particles that can cause unwanted electrical contacts to occur between the different electrical connections of the circuit.

In contactors according to the present state of the art, the electronic circuit, in the form of a printed circuit board, is arranged within a compartment in the cover, this compartment being bounded on the rear by a separating wall or partition. However, this compartment is not sealed, due to the fact that the plunger which actuates displacements of the contact plate passes axially and centrally through this compartment. As a result, given that the control plunger must slide axially through two axial holes, formed in the fixed magnetic core and in the separating partition, it is necessary to provide a radial clearance between the plunger and these holes. Thus, during axial displacements of the control plunger, dusts or humidity are able to enter the compartment in which the electronic circuit is mounted.

DISCUSSION OF THE INVENTION

An object of the invention is to overcome the above mentioned problem.

According to the invention, an electrical contactor of the type comprising a movable magnetic core which is displaceable coaxially, in the axial direction, in a winding, and which acts on a plunger that controls displacements of a contact plate for electrically connecting together two terminals of the contactor, the contactor further being of the type in which the control plunger extends axially forward through a hole formed in a fixed transverse core of the contactor, the fixed core being disposed axially in front of the winding, the contact plate being received within a hollow cover arranged in front of the winding, the contactor being also of the type in which an electronic circuit is disposed within the cover, between the fixed magnetic core and a separating plate through which the control plunger passes, is characterised in that the separating plate comprises a transverse wall portion and an axial bush in which the control plunger is arranged to slide axially, and in that the said bush is open at the front forward of the transverse wall portion and at the rear behind the fixed transverse core.

According to a preferred feature of the invention, the separating plate defines, within the cover, a front compartment in which the contacts and the contact plate are disposed, and a sealed rear compartment in which the electronic circuit is disposed. Preferably then, the axial bush of the separating plate has a rear axial end which is engaged sealingly in the hole of the fixed magnetic core. In preferred embodiments of this last mentioned arrangement, the rear axial end of the bush of the separating plate includes an internal radial collar portion which defines a substantially annular transverse face in axial engagement at the rear against a front face of the fixed magnetic core when the rear end of the bush is received in the hole of the fixed magnetic core.

According to another preferred feature of the invention, the axial bush of the separating plate has an axial front end which extends beyond the transverse wall portion and which defines an abutment surface for the contact plate.

According to a further preferred feature of the invention, the axial bush has a central bore which comprises a rear segment, in which a rear portion of the control plunger is guided, and a front segment of larger diameter. Preferably in that case, the contact plate is mounted for sliding movement on an intermediate portion of the control plunger; a helical compression spring is interposed between an external radial collar portion disposed behind the intermediate portion, and the contact plate, so as to urge the contact plate towards an advanced position; and the spring, which surrounds the intermediate portion, is received with the latter in the wide front segment of the axial bush when the control plunger is in a retracted or rest position.

The transverse wall portion of the separating plate preferably has stiffening ribs.

In some embodiments of the invention, the cover has a transverse face which faces towards the rear and which is disposed at the junction between the two said compartments of the cover, a peripheral edge portion of the transverse wall portion of the separating plate being in axial forward engagement with the said transverse face.

Preferably, the rear compartment of the cover, in which the electronic circuit is received, is substantially annular, around the axial bush of the separating plate.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
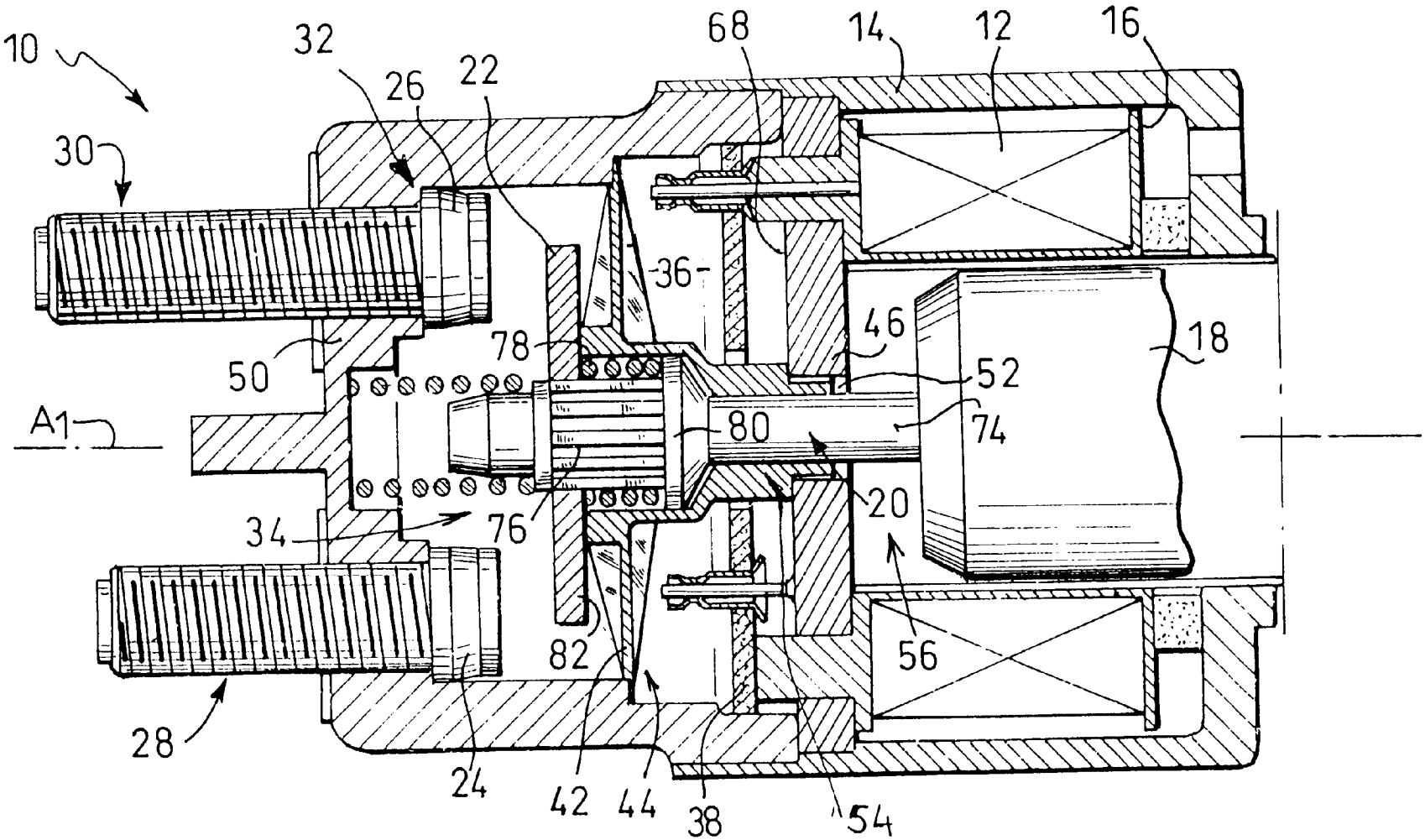
FIG. 1 is a view in axial cross section showing part of a starter contactor in accordance with the invention.

FIG. 1 shows a contactor 10 for an electric starter for the engine of a motor vehicle. The contactor 10 comprises an annular inductive winding 12 having an axis A1, which is arranged inside a substantially cylindrical casing 14 of the casing. The winding 12 is wound on a former, or winding body, 16.

A movable magnetic core 18, again substantially cylindrical, is arranged to slide axially within the winding 12, with which the core 18 is coaxial, between a retracted or rest position which is shown in FIG. 1, and a deployed or working position (not shown). In the working position, the movable core 18 is displaced from its rest position towards the left with reference to FIG. 1, by the magnetic field created by the winding 12 when the latter is energised by an electric current, in the usual way. The field lines, or lines of force, created by the winding 14 are closed by a fixed magnetic core 46 which extends transversely in front of the winding 12.

In the usual way, by being displaced towards its working position, the movable magnetic core 18 causes a starter pinion (not shown) to mesh with a toothed crown of the engine (not shown) of the vehicle. Simultaneously with this, the movable core 18 displaces axially a plunger 20 which in turn displaces axially a contact plate 22, from the retracted or rest position shown in FIG. 1 to the deployed or working position, in which the contact plate 22 is in axial engagement at the front against the heads 24 and 26 of two terminals 28, 30 respectively. One of these terminals is connected to the battery of the vehicle, the other one being connected to the electric starter motor. Thus, in the working position, the contact plate 22 closes the power supply circuit to the starter motor, which then drives the engine of the vehicle in rotation in order to start it.

Still in a known way, the contact plate 22 and the head 24 and 26 of the terminals 28 and 30 respectively are arranged inside a cover 32 which closes the casing 14 of the contactor 10 at the front of the casing.

Figure 2:
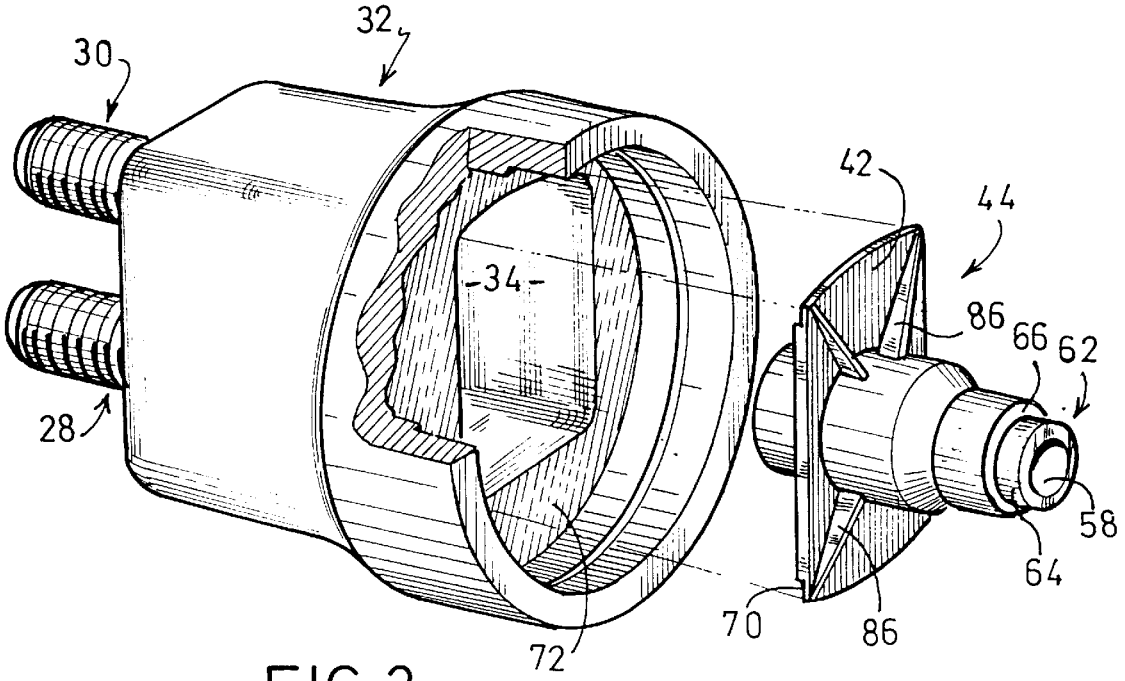
FIG. 2 is an exploded perspective view showing the cover (partly cut away) for the front end of the contactor, and the separating plate, of a contactor according to the invention.

As can be seen more particularly in FIG. 2, the contact plate 22 and the terminals 28 and 30 are received inside a front compartment 34 of the cover 32. The compartment 34 is substantially in the form of a parallelepiped, and is open into a cylindrical rear compartment 36 (see FIG. 1) of the cover 32. The rear compartment 36 enables the cover to be connected to the casing 14 of the contactor 10.

The contactor 10 includes a printed circuit board 38 which lies in a transverse plane and which is received within the rear compartment 36 of the cover 32. The printed circuit board 38 carries an electronic circuit for controlling the power supply to the inductive winding 12.

In a manner known per se, the rear compartment 36 of the cover is bounded axially on the inside, firstly by a front transverse wall portion 42 of a separating plate 44, and secondly, by the fixed transverse magnetic core 46. In this way the front compartment 34 of the cover 32 is bounded axially at the rear by the transverse wall portion 42 of the separating plate 44, and at the front by a front transverse wall 50, through which the threaded cylindrical body or shank of each of the terminals 28 and 30 extends axially to the outside.

Thus, the control plunger which connects the movable magnetic core 18 to the contact plate 22 extends axially through the rear compartment 36 of the cover 32, and in particular it extends through the fixed transverse magnetic core 46, via an axial hole 52 formed in the latter.

The body of the separating plate 44 is a substantially tubular axial bush 54, which seals the rear compartment 36 of the cover 32, at least to a substantial extent, from the front compartment 34 of the cover and from the central bore 56 of the winding body 16 in which the movable magnetic core 18 is displaceable. The axial bush 54 is in the form of a stepped cylindrical tube which has an internal bore 59 that comprises a rear segment 58 and a front segment 60. The diameter of the front segment 60 is larger than that of the rear segment 58.

Figure 3:
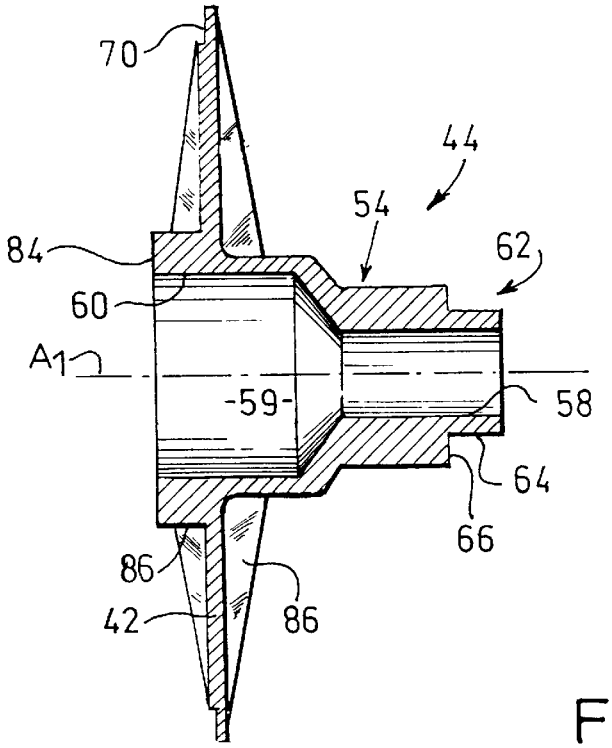
FIG. 3 is an enlarged view of the separating plate, seen in axial cross section.

As can be seen in FIGS. 1 and 3, the internal bore 59 of the axial bush 54 is open axially at the front of the wall portion 42, that is to say in the front compartment 34 of the cover 32. At the rear end, the bore 59 terminates in the hole 52 formed in the fixed magnetic core 46, so that the bore 59 of the bush 54 constitutes an axial passage which joins the internal bore 56 of the winding body 16 to the front compartment 34 of the cover. For this purpose, the rear axial end 62 of the bush 54 includes an internal radial collar portion 64 which defines a rearwardly facing transverse annular face 66. As can be seen in FIG. 1, it is the radial collar portion 64 that is received within the hole 52 of the fixed core 46, while the annular transverse face 66, or thrust shoulder, abuts axially on the front face 68 of the fixed core 46.

In addition, the transverse wall portion 42 of the separating plate 44 is arranged to engage axially at the front, through a peripheral edge portion 70 of the wall portion 42, against an internal transverse face 72 of the cover 32 (FIG. 2), facing towards the rear at the junction between the front compartment 34 and rear compartment 36 of the cover 32. As can be seen in FIG. 2, the transverse wall portion 42 is substantially in the form of a rectangle similar in profile to the transverse cross section of the front compartment 34, but slightly larger.

Thus when the cover 32 is fixed on the casing 14 of the contactor 10, the separating plate 44 is held axially between the cover 32 and the fixed magnetic core 46, the latter being itself fixed to the casing 14, so that the rear compartment 36 is now isolated from the front compartment 34 and from the bore 56 of the winding body 16.

The rear compartment 36 of the cover, through which the bush 54 extends, is therefore substantially annular in form, so that the printed circuit board 38 must itself also be annular. The latter accordingly includes a central passage for the bush 54.

As can be seen more particularly in FIG. 1, a rear portion 74 of the control plunger 20 is guided in axial sliding movement within the rear segment 58 of the internal bore 59 of the axial bush 54. The control plunger 20 is extended axially forward from its rear portion 74 by an intermediate portion 76, FIG. 1, on which the contact plate 22 is mounted for axial movement, and on which it is biassed axially forward by a compression spring 78. The spring 78 is interposed axially between an external radial collar portion 80, which is disposed at the rear end of the intermediate portion 76 of the control plunger, and the back face 82 of the contact plate 22.

When the control plunger 20 is in its rest position, the collar portion 80, the intermediate portion 76 and the compression spring 78 are effectively received within the front segment 60 of the internal bore 59 of the axial bush 54. In this position, the contact plate 22 is in abutment, through its rear transverse face 82, against an annular transverse front end face 84 (see FIG. 3) of the axial bush 54.

In order to limit bending of the transverse wall portion 42, the latter is provided with stiffening ribs 86 which lie in axial planes on each of the transverse faces, front and rear, of the wall portion 42.

What is claimed is:

1. An electrical contactor comprising: an annular winding defining an axis; a movable core, with means mounting the movable core coaxially within the winding for axial movement along said axis; a plunger extending coaxially forward from the movable core; a contact plate carried by the plunger; a fixed hollow cover disposed in front of the winding and receiving the contact plate within the cover; a pair of fixed terminals of the contactor disposed in front of the contact plate for engagement by the contact plate whereby to connect the terminals electrically together; a fixed transverse magnetic core having a central axial hole, the fixed core being axially in front of the winding and the plunger extending through the hole; a separating plate extending transversely to the axis within the cover; and an electronic circuit mounted within the cover between the fixed core and separating plate, the plunger extending through the separating plate, wherein the separating plate comprises a transverse wall portion and an axial bush projecting along the axis from the wall portion, the plunger extending through the bush for sliding movement therein and the bush being open at the front forwardly of the transverse wall portion, and at the rear behind the fixed core.

2. A contactor according to claim 1, wherein the cover defines within it a front compartment, the terminals and contact plate being disposed within the front compartment, and a sealed rear compartment, the electronic circuit being in the rear compartment.

3. A contactor according to claim 2, wherein the axial bush of the separating plate has an axial rear end received sealingly in the hole of the fixed core.

4. A contactor according to claim 3, wherein the axial rear end of the bush includes an internal radial collar portion defining a substantially annular rearwardly facing transverse face, the fixed core having a front face, the rear end of the bush being received in the hole in the fixed core with the substantially annular transverse face of the bush being in axial abutment against the front face of the fixed core.

5. A contactor according to claim 1, wherein the axial bush has an axial front end extending forwardly beyond the transverse wall portion of the separating plate, whereby to constitute an abutment surface for the contact plate.

6. A contactor according to claim 1, wherein the axial bush defines a central bore having a rear segment and a front segment, the plunger having a rear portion guided within the rear segment, the front segment having a diameter larger than that of the rear segment.

7. A contactor according to claim 6, wherein the plunger further includes an intermediate portion forward of the rear portion of the plunger, an external radial collar portion joining the intermediate and rear portions of the plunger, the contact plate being mounted on the intermediate portion for sliding movement thereon, the contactor further including a helical compression spring interposed between the external radial collar portion and the contact plate, whereby to bias the latter towards an advanced position, the spring surrounding the intermediate portion of the plunger, the contactor defining a rest position of the plunger in which the contact plate is out of contact with the terminals, whereby the spring and intermediate plunger portion are received in the front segment of the bore of the axial bush of the separating plate when the plunger is in the rest position.

8. A contactor to claim 1, wherein the separating plate further includes stiffening ribs on the transverse wall portion.

9. A contactor according to claim 2, wherein the cover has a rearwardly facing transverse face at the junction between the front and rear compartments of the cover, the transverse wall portion of the separating plate having an edge portion for forward axial abutment against the transverse face of the cover.

10. A contactor according to claim 2, wherein the rear compartment of the cover is substantially annular around the bush.

* * * * *